US005765356A

United States Patent [19]

Zöpfl et al.

[11] Patent Number: 5,765,356

[45] Date of Patent: Jun. 16, 1998

[54] SPINNING MACHINE TUBE TRANSPORT AND REMOVAL SYSTEM

[75] Inventors: Karl Zöpfl, Ingolstadt; Thomas-Georg Meier, Wettstetten, both of Germany

[73] Assignee: Rieter Ingolstadt Spinnereimaschinenbau AG, Ingolstadt, Germany

[21] Appl. No.: 810,631

[22] Filed: Feb. 28, 1997

[30] Foreign Application Priority Data

Mar. 7, 1996 [DE] Germany ..... 196 08 789.9

[51] Int. Cl.[6] ..... D01H 9/10; D01H 9/14

[52] U.S. Cl. ..... 57/281; 57/266; 57/273; 242/35.5 A

[58] Field of Search ..... 57/266, 273, 274, 57/276, 281, 90; 242/35.5 A

[56] References Cited

U.S. PATENT DOCUMENTS

| | | | |
|---|---|---|---|
| 2,643,761 | 6/1953 | Wagner et al. . | |
| 4,528,721 | 7/1985 | Hera | 57/276 |
| 4,565,278 | 1/1986 | Asai et al. | 242/35.5 A |
| 4,641,740 | 2/1987 | Greksch et al. . | |
| 4,655,665 | 4/1987 | Lattion | 57/276 |
| 4,730,733 | 3/1988 | Kawamura et al. | 242/35.5 A |
| 4,817,373 | 4/1989 | Gualchierani | 57/276 |
| 5,207,051 | 5/1993 | Inger et al. | 57/90 |
| 5,226,922 | 7/1993 | Mori | 242/35.5 A |
| 5,316,126 | 5/1994 | Hirai | 242/35.5 A |
| 5,568,720 | 10/1996 | Teich et al. | 57/90 |
| 5,620,299 | 4/1997 | Grabovsky et al. . | |

FOREIGN PATENT DOCUMENTS

| | | |
|---|---|---|
| 0262726 | 4/1988 | European Pat. Off. . |
| 0474990 | 10/1994 | European Pat. Off. . |
| 1285404 | 12/1968 | Germany . |
| 2814956 | 10/1978 | Germany . |
| 4238548A1 | 5/1994 | Germany . |
| 2042482 | 9/1980 | United Kingdom . |
| 2129451 | 5/1984 | United Kingdom . |

OTHER PUBLICATIONS

European Patent Office Search Report, Jul. 11, 1997.
German Search Report, Jun. 20, 1996.

*Primary Examiner*—William Stryjewski
*Attorney, Agent, or Firm*—Dority & Manning

[57] ABSTRACT

In a spinning machine with a tube magazine (1) several tube mandrils (3) placed on a conveyor are provided for the placement of a tube (4) at a time. At a removal station (2) a take-up device 21 to take up individual tubes (4) from the tube magazine (1) is provided. A nose (13) is provided at the free end of the tube mandril (3). The length (L) of the tube mandril (3) between conveyor and nose (13) is greater than the length (I) of the tube (4). The nose (13) has a smaller outside diameter (d) than the inside diameter (D) of the tube (4). A device to lift the tube (4) is provided at the removal station (2).

14 Claims, 2 Drawing Sheets

SPINNING MACHINE TUBE TRANSPORT AND REMOVAL SYSTEM

BACKGROUND OF THE INVENTION

The present invention relates to a spinning machine of the type wherein tubes are supplied from a tube magazine.

A device of this type is known from DE 44 40 015 A1 in which tubes are conveyed to a receiving station. At the receiving station, the tubes are taken by means of a transfer apparatus from the conveyor of a tube magazine and are transferred to a conveyor belt of a tube feeder. The tubes are placed on tube mandrils of a chain and are conveyed to the transfer apparatus. It is a disadvantage in this device that tube guides must be provided in order to avoid that tubes slide off accidentally from the tube mandrils. In order to ensure reliable removal of the tubes at the transfer apparatus, tube mandrils are provided which hold the tubes in a centered manner. This ensures that a grasper of the transfer apparatus is able to grasp the tube securely at a predetermined location and can convey it to the tube feeder. It is a disadvantage with such tube mandrils that different mandrils must be provided for the many possible tube configurations which may vary in diameter, form and length.

OBJECTS AND SUMMARY OF THE INVENTION

It is an object of the present invention to avoid the above-mentioned disadvantages, whereby the secure removal of the tubes from the tube magazine may not be affected. Additional objects and advantages of the invention will be set forth in part in the following description, or may be obvious from the description, or may be learned through practice of the invention.

At the free end of the tube mandril a nose is installed at a distance from the conveyor which is greater than the length of the tube. The nose has a smaller outside diameter than the inside diameter of the tube. This ensures that any kind of tube can be taken up on the tube mandril. The nose ensures that the tube is not caused by vibrations at the spinning machine to slide from the tube mandril. If a device to lift the tube is provided at the removal station, this makes it possible to remove the tube easily from the tube mandril. It is especially advantageous if the tube is lifted sufficiently so that its axis coincides substantially with the center of the nose. This ensures a secure removal from the tube mandril. Preferably the nose has an essentially round cross-section in a plane which is perpendicular to the axis of the tube mandril. This always ensures in case of deflection of the conveyor that the tube is always located on the tube mandril. The tube is thus reliably prevented from sliding off.

It is advantageous for the conveyor for the conveying of the tubes to the removal location to be a driven chain. Deflection, and thereby a space-saving arrangement of the conveyor and of the tube magazine is made possible in a known manner by means of the chain. The conveyor can serve simultaneously as tube magazine, in that the chain is deflected as tightly and often as possible on a space provided for the magazine and thus makes it possible to store a large number of tubes by providing an equally large number of tube mandrils. It is however also possible for the tubes to be taken from a magazine, in which they are stacked one above the other and to be transferred to the conveyor to be then conveyed by means of the conveyor to the removal station.

If a tube mandrel is located at a shackle of the chain, a simple attachment of the tube mandrel is possible. Furthermore, a plurality of tubes can be stored in the narrowest possible space.

An especially advantageous and simple device to lift the tube is a prism in which the tube lies as it is removed. The prism ensures a secure position of the tube. Vibrations of the spinning machine do not cause the tube to shift. The tube can be easily grasped by the removal device in this manner or can be conveyed to the removal device.

If a tube ramp is provided in front of the removal station, a gradual lifting of the tube to the level of the upper edge of the prism is effected. As soon as the tube is within range of the prism it drops into the prism and assumes a secure and stable position.

By placing a sliding block before the removal station, the tube mandrels are adjustable vertically. In this manner, a secure conveying of the tubes to the prism is ensured. Furthermore, even in case where the tube mandrel is leaning because of stress of the material of which said tube mandrel is made, it is ensured that the tube mandrel will still remain in a defined position relative to the tube located in the prism.

It is especially advantageous if the sliding block, the tube ramp and/or prism can be adjusted vertically. This ensures that different tube diameters can be removed reliably.

If a slide to slide the tube from the tube mandrel into the removal device is provided in the area of the removal station, a simple transfer of the tube from the conveyor to the removal device is ensured.

In another embodiment the invention has the advantage that asymmetric tubes can be installed on the tube mandrel whatever their orientation may be, if the orientation of the tube lying at the removal station can be determined by means of a sensor. In this case the tube can be rotated as needed before further handling after it has been removed.

An example of an embodiment of the invention is described in the following figures.

DETAILED DESCRIPTION OF THE PREFERRED EMBODIMENTS

Figure 1:
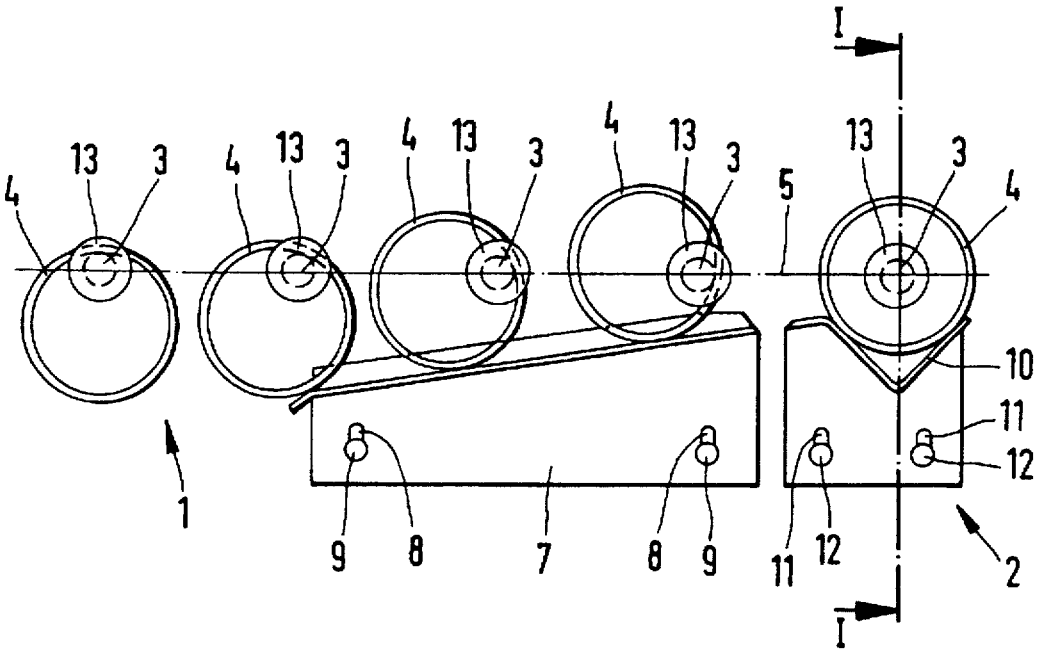
FIG. 1 shows a removal station, in a front view.

Reference will now be made in detail to the presently preferred embodiments of the invention, one or more examples of which are illustrated in the drawings. Each example is provided by way of explanation of the invention, and not meant as a limitation of the invention. In fact, features illustrated or described as part of one embodiment can be used on another embodiment to yield a still further embodiment.

In FIG. 1, the removal station 2 is shown in a front view. A tube magazine 1 is shown in the form of five tube mandrels 3. The tube magazine normally, and depending on where it is located, contains up to several hundred tubes. If it is used in a maintenance device for example, the number of stored tubes 4 is limited to significantly fewer tubes. In this case normally approximately ten tubes 4 are carried in the tube magazine. If the tube magazine is located in a rotor spinning machine or winding machine, up to 500 tubes 4 must be stored here.

The left tube 4 shown in FIG. 1 hangs on the tube mandril 3. A nose 13 at the free end of the tube mandril 3 prevents the tube 4 from sliding off said tube mandril 3. The tube mandrils 3 are installed on a chain 5 which is merely suggested. As the chain 5 is moved in the direction of the removal station 2, the tubes 4 are pulled on a ramp 7. This causes the tube 4 to be lifted slowly off the tube mandril 3 and to be pulled in the direction of the removal station 2.

The removal station 2 consists of a prism 10. This prism 10 is positioned relative to the tube mandril 3 in such manner that the tube has no additional contact with the tube mandril 3 or with the nose 13. Ideally, the prism 10 is adjusted so that the axis of the tube 4 lying in the prism 10 coincides with the axis of the tube mandril 3 or the center of the nose 13. This ensures that secure removal of the tube by pushing or pulling the tube over the tube mandril 3 and the nose 13 is achieved.

To be able to make adjustment for different types of tubes, an adjustment in vertical direction is provided on the ramp 7 as well as on the prism 10. This is effected by means of longitudinal openings 8 or 11 as well as screws 9 or 12. The height adjustment of ramp 7 and prism 10 makes it possible to obtain optimal adjustment as a function of the different tube diameters and tube forms.

Figure 2:
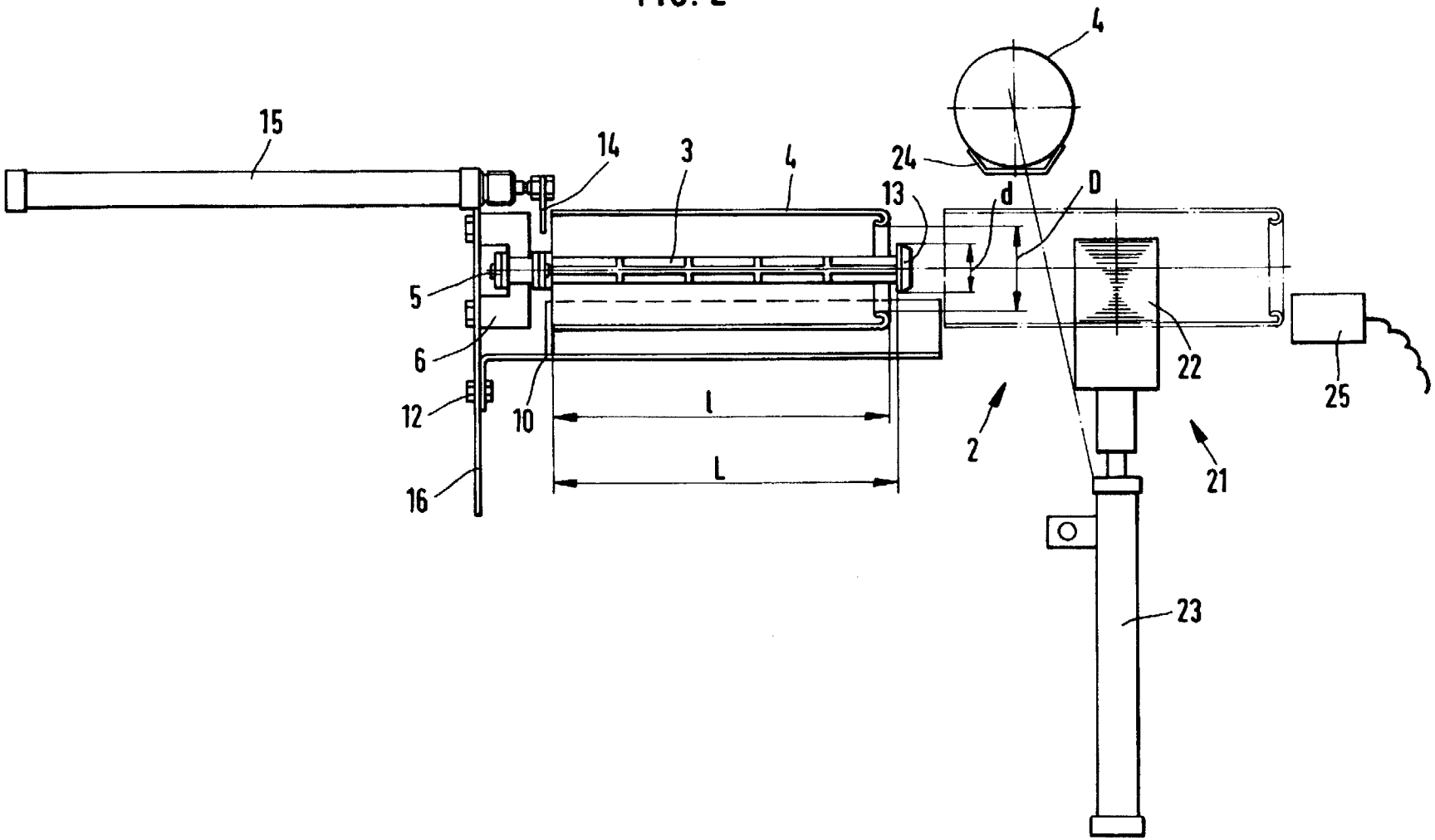
FIG. 2 shows a removal station in section I—I

FIG. 2 shows a section I—I from FIG. 1 through the removal station. The tube 4 lies in the prism 10 and is centered relative to the tube mandril 3. The tube mandril 3 is provided with a nose 13 with a round cross-section which is also centered relative to the axis of the tube mandril 3. The diameter d of the nose 13 is less than the inside diameter D of the tube. This ensures that the tube 4 can be removed from the tube mandril 3 without contact with the nose 13. Removal is effected by means of a slide 14 which is actuated by a pneumatic cylinder 15. Actuation of the pneumatic cylinder 15 moves the slide in the axial direction of the tube 4 or of the tube mandril 3. The slide 14 is placed so that it seizes the tube 4 at its end and pushes it in the direction of a removing device 21 as it lies on the prism 10. It has a length sufficient to push the tube 4 into the position of tube 4 represented by hatch marks. The removal device 21 is positioned with open grasper 22 in front of the prism 10. The tube 4 is pushed on the prism 10 into the open grasper 22. As soon as the tube 4 is in the desired position, the grasper 22 is closed in a manner not shown here and thereby grasps the tube 4. The tube is rotated by 90° by means of a pneumatic cylinder 23 in the present embodiment and is conveyed to a place of deposit 24, e.g. by a swiveling motion of the pneumatic cylinder 23.

As an option, a sensor 25 which recognizes the orientation of the tube 4 at the removal station 2 can be placed in proximity of the tube 4, e.g. near the prism 10 or the take-up device 21. This is especially useful if the tube 4 is a tube with non-identical ends, e.g. a flanged tube. The grasper 22 of the take-up device 21 is controlled as a function of the signal of the sensor 25 in such a manner that it swivels the tube by +90° or −90° so as to deposit the tube 4 always with the same orientation in the place of deposit 24.

As can be seen in FIG. 2, the tube mandril 3 is longer than the tube 4. While the tube 4 has a length I, the nose 13 which delimits the length L of the tube mandril 3 is at a distance from the chain 5 that is greater than the length I of the tube 4.

The prism 10 as well as the pneumatic cylinder 15 and a chain guide 6 are attached to a wall 16. The prism 10 is attached by means of screws 12 so as to be adjustable in height relative to the tube mandril 3.

Figure 3:
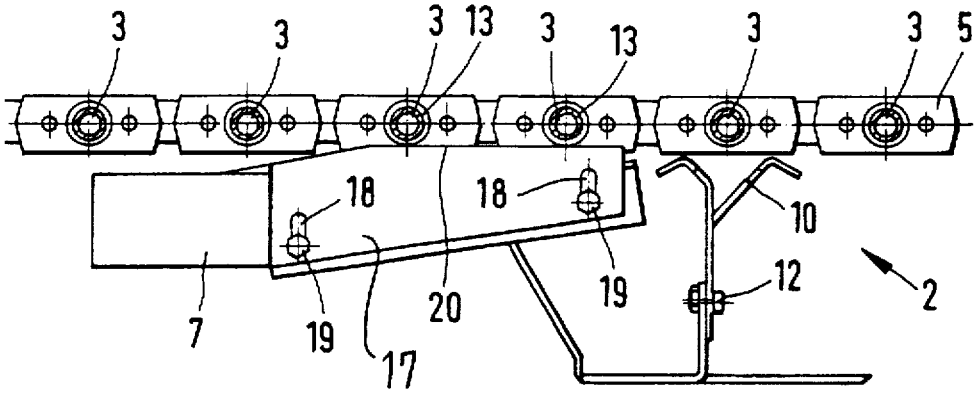
FIG. 3 shows a removal station in a front view.

FIG. 3 shows-an embodiment similar to that of FIG. 1. While the movement of the tubes 4 is visible in FIG. 1, the removal station 2 is shown without tubes 4 in FIG. 3. The tube mandrils 3 are located on the shackles of the chain 5. In proximity of the ramp 7, a sliding block 17 is provided. The sliding block 17 serves to support the tube mandrils 3 immediately before the prism 10. The nose 13 of the tube mandril 3 slides on the sliding block 17 and moves the tube mandril 3 in a defined vertical position. By moving at least the two tube mandrils 3 located before the prism 10 on the sliding block 17, it is ensured that the tube mandril 3 located near the prism 10 will assume a defined position. This is ensured by the chain guide 6 shown in FIG. 2, as well as by the twist rigidity of the chain 5. The sliding block 17 can be adjusted vertically by means of the longitudinal openings 18 and the screw 19. With this the position of the tube mandril 3 relative to the prism 10 can be adjusted so as to ensure trouble-free removal of the tube 4 from the tube mandril 3.

It should be apparent to those skilled in the art that various modifications and variations can be made in the present invention without departing from the scope and spirit of the invention. It is intended that the present invention cover such modifications and variations as come within the scope of the appended claims and their equivalents.

We claim:

1. A textile machine with a tube conveying system, comprising:

a tube magazine having a conveyor with a plurality of tube mandrils mounted on said conveyor at one end of said mandrils and disposed so as to extend from said conveyor, said mandrils carrying tubes thereon;

a removal station disposed relative to said tube magazine, said removal station having a take-up device operationally disposed relative to said tube magazine for removing individual said tubes from said magazine;

each of said mandrils comprising a nose piece at an opposite end thereof from said conveyor, said mandrils comprising a length between said conveyor and said nose piece greater than a length of said tubes carried on said mandrils;

said nose piece having a diameter smaller than an inside diameter of said tubes carried on said mandrils; and a lifting device disposed at said removal station relative to said tube magazine to lift said tubes off of said mandrils prior to said tubes being removed by said take-up device.

2. The textile machine as in claim 1, wherein said conveyor comprises a driven chain operably disposed at least partially within said magazine.

3. The textile machine as in claim 2, wherein said mandrils are disposed on shackles of said chain.

4. The textile machine as in claim 1, wherein said lifting device comprises a prism into which said tubes are conveyed and in which said tubes lie as the are engaged by said take-up device.

5. The textile machine as in claim 4, wherein said prism is disposed relative to said conveyor so that said tubes do not contact said mandrils once they come to lie in said prism.

6. The textile machine as in claim 4, wherein said lifting device comprises a tube ramp disposed before said prism in a conveying direction of said conveyor, said tube ramp engaging said tubes and repositioning said tubes relative to said mandrils as said tubes are conveyed up said tube ramp.

7. The textile machine as in claim 6, further comprising a sliding block mechanism operably disposed before said removal station in the conveying direction of said conveyor, said sliding block mechanism contacting said mandrils as they are conveyed therealong for vertical adjustment of said mandrils.

8. The textile machine as in claim 7, wherein said sliding block, said tube ramp, and said prism are vertically adjustable.

9. The textile machine as in claim 4, further comprising a sliding block mechanism operably disposed before said removal station in the conveying direction of said conveyor, said sliding block mechanism configured for vertical adjustment of said mandrils.

10. The textile machine as in claim 1, further comprising a slide device disposed at said removal station to slide said tubes from said lifting device away from mandrils.

11. The textile machine as in claim 1, further comprising a sensor device installed at said removal station to ascertain the orientation of said tubes.

12. The textile machine as in claim 11, wherein said take-up device is movable to re-orient said tubes in response to a signal from said sensor device.

13. The textile machine as in claim 1, wherein said nose piece has a substantially round cross section in a plane perpendicular to an axis of said mandrils, and said lifting device moves said tubes relative to said mandrils so that said nose piece is essentially centered relative to said inside diameter of said tubes.

14. A textile machine with a tube conveying system, comprising:

a tube magazine having a conveyor with a plurality of tube mandrils mounted on said conveyor at one end of said mandrils and disposed so as to extend from said conveyor, said mandrils carrying tubes thereon;

a removal station disposed relative to said tube magazine having a take-up device disposed to take up individual said tubes from said magazine;

each of said mandrils comprising a nose piece at an opposite end thereof from said conveyor, said mandrils comprising a length between said conveyor and said nose piece greater than a length of tubes carried on said mandrils;

said nose piece having a diameter smaller than an inside diameter of said tubes carried on said mandrils;

a prism disposed at said removal station into which said tubes are conveyed and in which said tubes lie as they are engaged by said take-up device;

a tube ramp disposed before said prism in a conveying direction of said conveyor, said tube ramp engaging and re-orienting said tubes relative to said mandrils as said tubes are conveyed up said tube ramp prior to being conveyed into said prism, said tubes supported in said prism without contacting said mandrils; and a slide mechanism disposed at said removal station to slide said tubes from said mandrils for take up by said take-up device.

* * * * *